US005878298A

United States Patent [19]

Nakano

[11] Patent Number: 5,878,298

[45] Date of Patent: Mar. 2, 1999

[54] IMAGE FORMING APPARATUS MOUNTING EXCHANGE UNIT WITH MEMORY

[75] Inventor: Masaki Nakano, Ebina, Japan

[73] Assignee: Canon Kabushiki Kaisha, Tokyo, Japan

[21] Appl. No.: 904,015

[22] Filed: Jul. 31, 1997

[30] Foreign Application Priority Data

Aug. 9, 1996 [JP] Japan ..... 8-211017

[51] Int. Cl.[6] ..... G03G 15/00

[52] U.S. Cl. ..... 399/24; 399/88

[58] Field of Search ..... 399/24, 25, 26, 399/18, 77, 79, 88; 395/182.2, 750.05, 750.06, 750.07

[56] References Cited

U.S. PATENT DOCUMENTS 5,452,059 9/1995 Sekiya ..... 399/25

*Primary Examiner*—Joan Pendegrass

*Attorney, Agent, or Firm*—Fitzpatrick, Cella, Harper & Scinto

[57] ABSTRACT

In an image forming apparatus which mounts a photosensitive drum cartridge with a memory, even when a power switch is turned off while data indicating the number of copies is being written in the memory of the cartridge after a paper sheet is discharged, the power OFF operation is ignored, and the power supply is maintained. After the count value has been written in the memory, the power supply is turned off.

24 Claims, 4 Drawing Sheets

IMAGE FORMING APPARATUS MOUNTING EXCHANGE UNIT WITH MEMORY

BACKGROUND OF THE INVENTION

1. Field of the Invention

The present invention relates to an image forming apparatus which stores data in a memory provided to an exchange unit.

2. Description of the Related Art

In a recently proposed copying machine and printer that use an electrophotography process, an exchange unit including a photosensitive drum as an expendible member adopts a detachable structure, and an EEPROM as a storage means is built in the exchange unit. Data such as the number of processed copies, and the like are stored in the EEPROM, and when the predetermined number of processed copies has been reached, the user is advised to exchange the exchange unit.

In such copying machine, a paper discharge sensor detects that fixing processing has ended and that a paper sheet has been discharged onto a paper discharge unit. A paper discharge detection signal from the paper discharge sensor is supplied to a CPU that controls the entire system. The CPU reads out, in advance, the number of previously processed copies stored in the EEPROM in the exchange unit, increments the readout number of previously processed copies by 1, and supplies the incremented value to the EEPROM to write the new number of processed copies. In this manner, the storage value of the EEPROM in the exchange unit is updated every time one paper sheet is discharged, and serves as a counter. When the storage value has reached a predetermined value, the CPU determines that the life of the photosensitive drum is finished, and displays a message prompting a user to exchange the exchange unit.

However, since the storage value of the EEPROM in the exchange unit is updated after the paper sheet is turned off during the interval from the timing immediately after paper discharge and before the end of writing into the EEPROM, the count value in the EEPROM may not be updated, or a random value may be written, i.e., data may be destroyed in some cases.

SUMMARY OF THE INVENTION

It is an object of the present invention to provide an image forming apparatus which can solve the above-mentioned problems.

It is another object of the present invention to provide an image forming apparatus which keeps the power supply ON while data is being written in a memory of an exchange unit.

It is still another object of the present invention to provide an image forming apparatus which can correctly write data in a memory of an exchange unit.

Other objects of the present invention will become apparent from the following description taken in conjunction with the accompanying drawings and the appended claims.

DETAILED DESCRIPTION OF THE PREFERRED EMBODIMENTS

The preferred embodiments of the present invention will be described in detail hereinafter with reference to the accompanying drawings.

Figure 1:
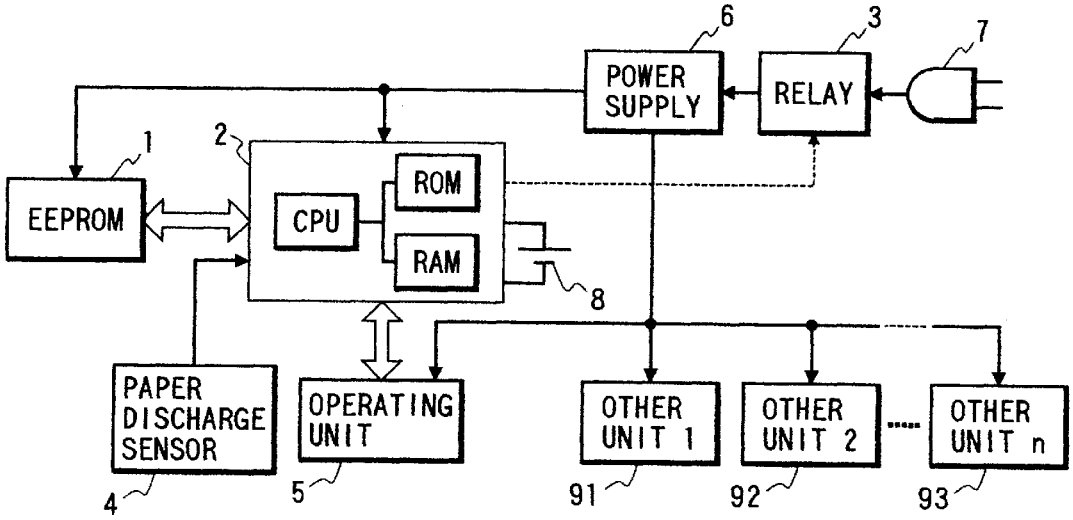
FIG. 1 is a block diagram showing the first embodiment of he present invention.

FIG. 1 is a block diagram of a copying machine according to the first embodiment of the present invention, and mainly shows only blocks necessary for the present invention.

Figure 3:
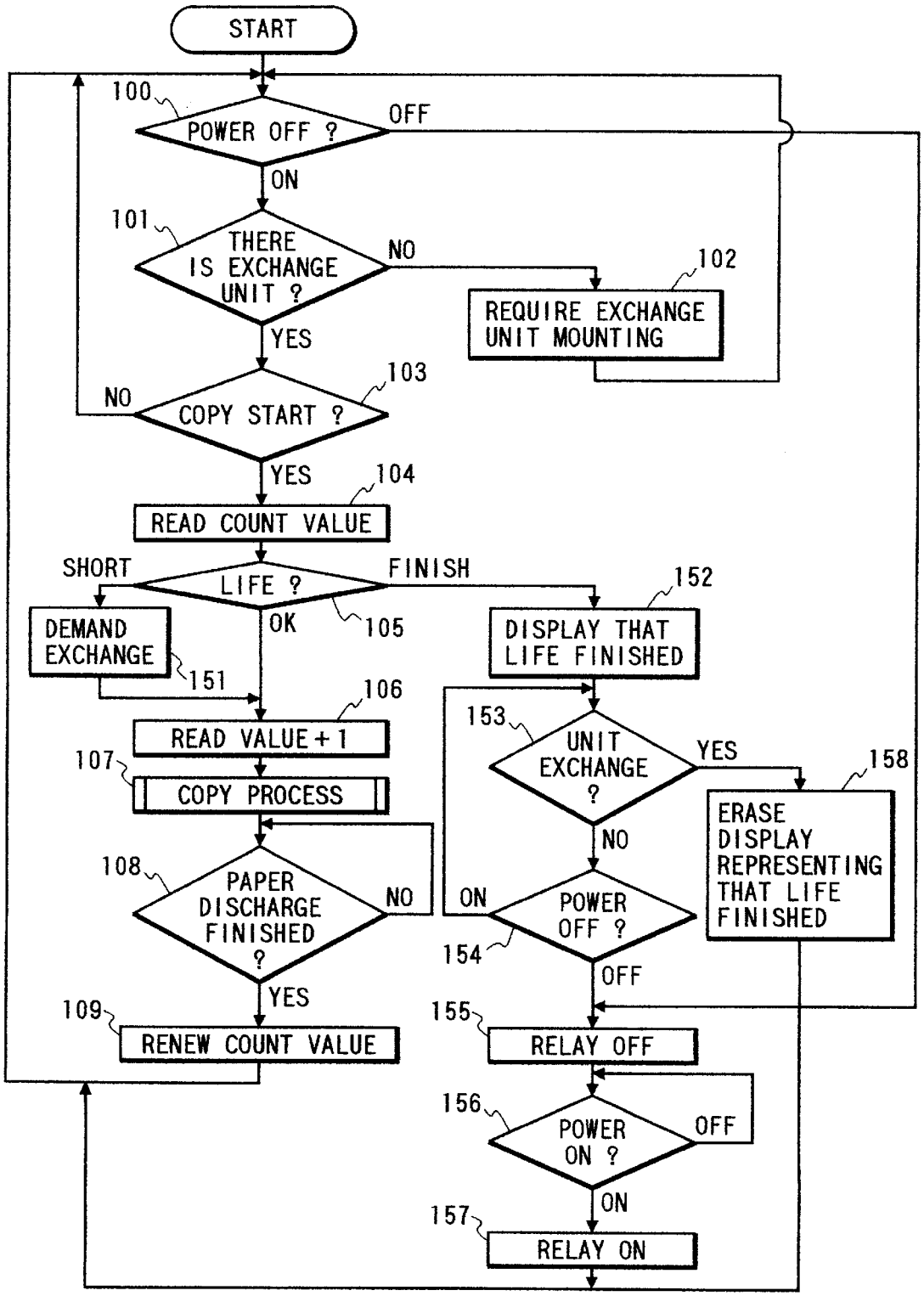
FIG. 3 is a flow chart showing the operation of the first embodiment.

Referring to FIG. 1, an EEPROM 1 is arranged in an exchange unit including a photosensitive unit. A control unit 2 controls the entire copying machine system, and reads/writes data from/in the EEPROM 1. The control unit 2 has a CPU, a ROM storing the control procedure of the CPU as shown in FIG. 3, and a RAM serving as a temporary storage means for data. A relay 3 turns on/off the input from an AC line. A paper discharge sensor 4 detects if a paper sheet is discharged outside the machine. An operation unit 5 includes switches to be operated by the user, displays, and the like. A power supply 6 supplies the power supply voltage(s) to the entire copying machine. A plug 7 is connected to the AC line. A battery 8 supplies a power supply voltage to the internal circuit of the control unit 2, which is required to be backed up by the battery even when the power supply 6 is OFF. The copying machine also includes other units 91 to 93.

An AC power supply voltage input from the AC plug 7 is supplied to the power supply 6 via relay 3. The power supply 6 generates a DC power supply voltage required in the individual units of the copying machine on the basis of the supplied AC power supply voltage, and supplies the DC power supply voltage to various blocks such as the EEPROM 1, the control unit 2, and the like. The control unit 2 controls the entire copying machine in accordance with various kinds of operation information input from the operation unit 5, and also processes communication control with the EEPROM, ON/OFF-control of the relay 3, display control of the operation unit 5, and the like.

The operation of this embodiment will be described below with reference to the flow chart in FIG. 3.

The control unit 2 checks in step 100 if the power supply is OFF. If the power supply is ON, the control unit 2 checks if an exchange unit is mounted (101). If no exchange unit is mounted, the control unit 2 displays a mounting request (102). If an exchange unit is mounted, the control unit 2 waits for a copy start instruction in step 103.

Upon reception of a copy start instruction from the operation unit 5, the control unit 2 reads the count value of the number of processed copies stored in the EEPROM 1 (104). The control unit 2 checks the read count value in step 105. If the count value has reached a predetermined value indicating that the life of the photosensitive drum is finished, the flow advances to step 152; if the count value is near the predetermined value (within a given value range from the predetermined value), the control unit 2 displays, on a display of the operation unit, a message indicating that the remaining life is short in step 151, and thereafter, the flow advances to step 106. On the other hand, if the count value is not within that given value of the predetermined value, the flow directly advances to step 106. The control unit 2 increments the read count value of the EEPROM by 1 in step 106, executes a copy process in step 107, and waits until the paper discharge sensor 4 detects paper discharge in step 108. In step 109, the control unit 2 writes the incremented count value in the EEPROM 1, and the flow returns to step 100. As described above, after a copy start instruction is input (103), power OFF is not checked until the count value of the EEPROM has been updated (109), even when a power OFF operation is made at the operation unit 5. After step 109, power OFF checking is repeated in step 100.

If it is determined in step 105 that the count value of the EEPROM 1 has reached the predetermined value, the control unit 2 displays, on the display of the operation unit 5, a message indicating that the life of the photosensitive drum is finished, in step 152. Thereafter, the control unit 2 waits until the unit is exchanged or the power is turned OFF in step 153 or 154. If the unit is exchanged, the control unit 2 erases the message indicating that the life is finished on the display in step 158, and the flow returns to step 100. On the other hand, if a power OFF operation is made at the operation unit 5 in step 154 or 100, the control unit 2 turns off the relay 3 in step 155, and waits until the power supply is turned on again in step 156. If the power supply is turned on, the control unit 2 turns on the relay 3 (157), and the flow returns to step 100.

In addition to the above-mentioned embodiment, the operation of the relay 3 may be delayed to keep supplying electric power even when the power switch is turned off, from when the paper discharge sensor 4 detects paper discharge until the time period required for updating the count value of the EEPROM 1 has elapsed. Alternatively, the operation of the relay 3 may be delayed to keep supplying electric power even when the power switch is turned off from the beginning of updating of the count value of the EEPROM 1 until a predetermined period of time has elapsed.

Figure 2:
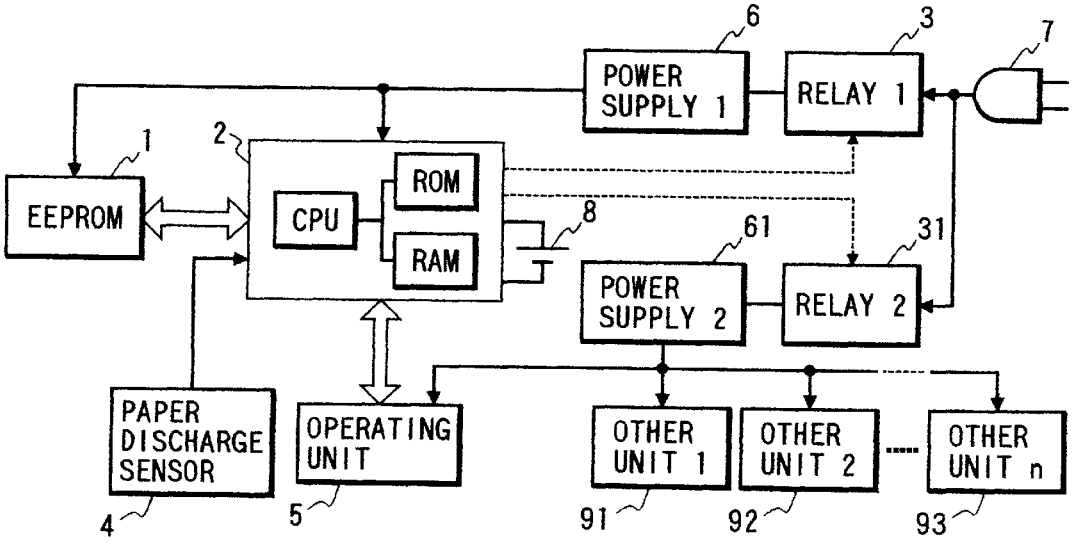
FIG. 2 is a block diagram showing the second embodiment of e present invention.

FIG. 2 is a block diagram showing the second embodiment. In FIG. 2, a second power supply 61 and a second relay 31 for turning on/off an AC power supply voltage supplied from the AC plug 7 to the second power supply 61 is added to the arrangement of the first embodiment shown in FIG. 1. The first power supply 6 supplies electric power to the EEPROM 1 and the control unit 2, and the second power supply 61 supplies electric power to the operation unit 5 and the units 91 to 93.

In this embodiment, when a power OFF operation is made at the operation unit 5, if it is done immediately after paper discharge and data in the EEPROM 1 has not been updated yet, the control unit 2 outputs a control signal to the second relay 31 to turn off the second relay 31 alone, and does not turn off the first relay 3 for the first power supply 6 that supplies electric power to the count function system such as the control unit 2, the EEPROM 1, and the like. Upon completion of data writing into the EEPROM 1, the control unit 2 outputs a control signal to the first relay 3 to turn off all the power supplies.

Figure 4:
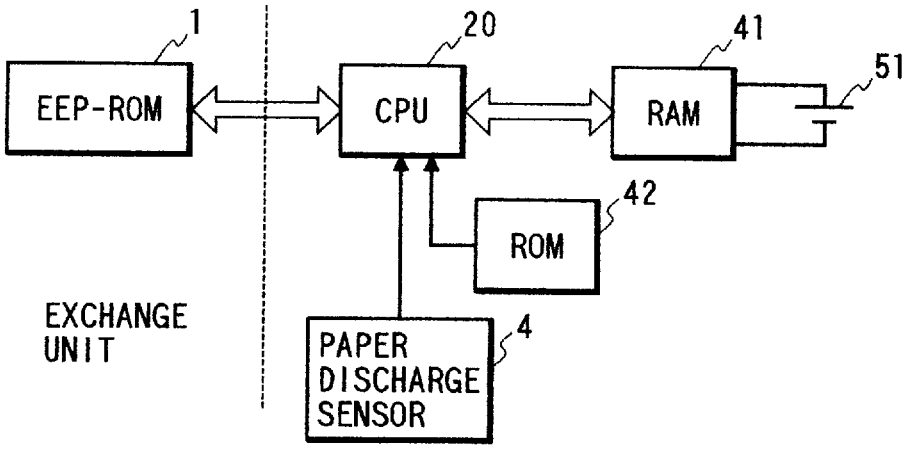
FIG. 4 s a block diagram showing the third embodiment of present invention.

FIG. 4 is a block diagram showing only blocks necessary for the present invention of a copying machine according to the third embodiment of the present invention.

Figure 7:
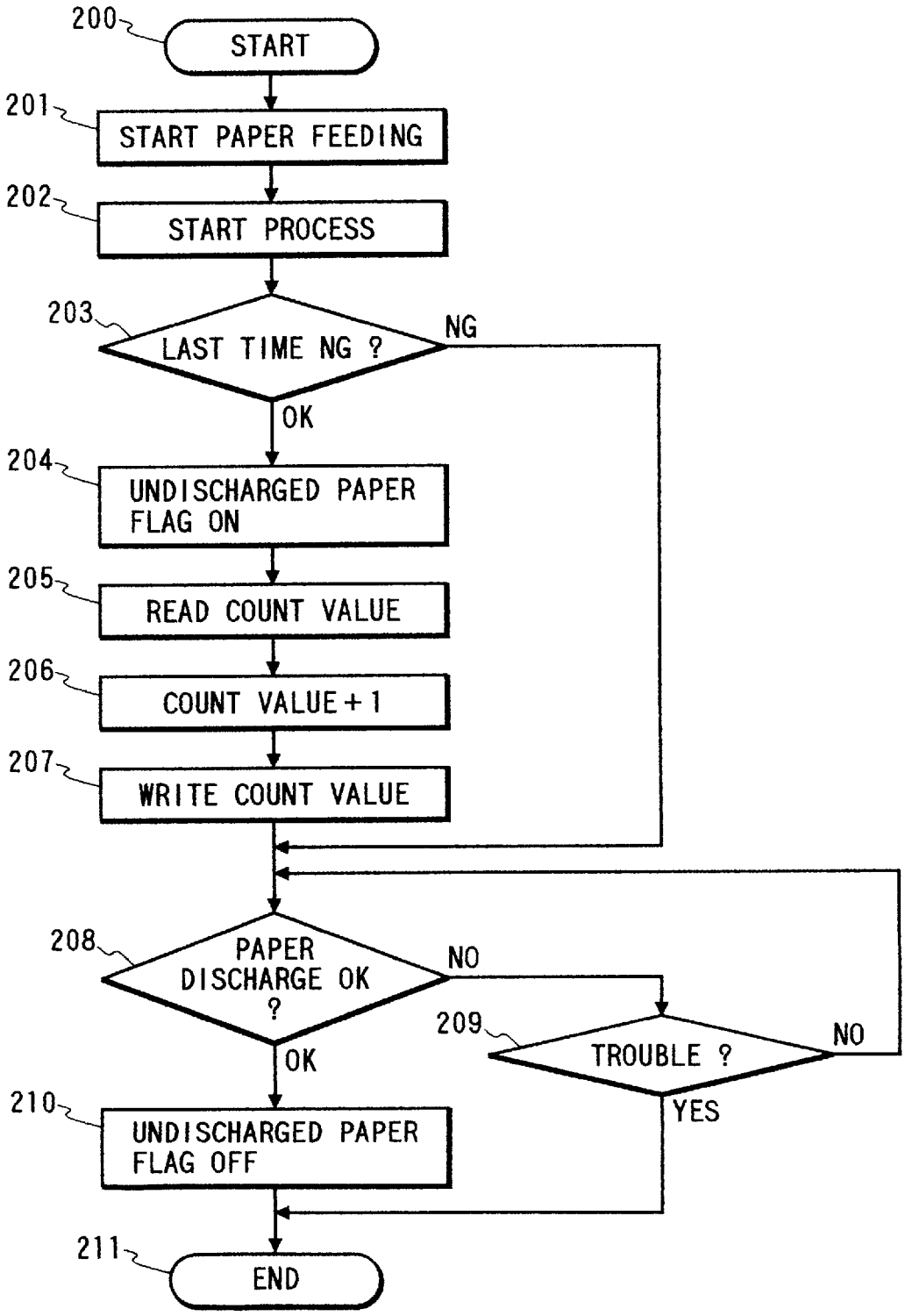
FIG. 7 is a flow chart showing the operation of the third embodiment.

Referring to FIG. 4, an EEPROM 1 is arranged in an exchange unit. A CPU 20 controls the entire copying machine system, and reads/writes data from/in the EEPROM 1. A ROM 42 stores the control procedure of the CPU as shown in FIG. 7. A RAM 41 serves as a temporary storage means of data for the CPU 20. A paper discharge sensor 4 detects discharge of a paper sheet on which an image has been formed. A backup power supply 51 backs up the RAM 41.

Figure 5:
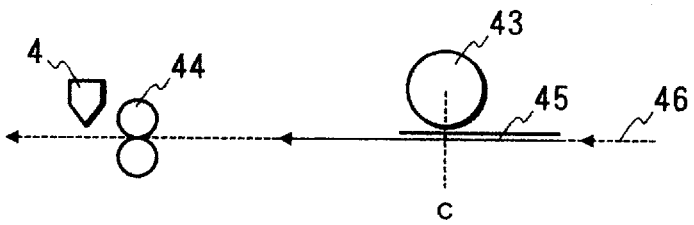
FIG. 5 is a schematic view showing a paper convey path portion the third embodiment.

FIG. 5 is a schematic view showing the paper convey route of the copying machine. FIG. 5 illustrates the paper discharge sensor 4, a photosensitive drum 43, a fixing device 44, a paper sheet 45, and a paper convey route 46.

In FIG. 4, the EEPROM 1 is electrically connected to the CPU 20, which reads/writes data from/in the EEPROM 1. Also, the CPU 20 is electrically connected to the paper discharge sensor 4, the RAM 41, various sensors and actuators (not shown), and the like.

The paper discharge sensor 4 detects discharge of a paper sheet after the image forming process, and informs the CPU 20 of it. The RAM 41 stores various kinds of information under the control of the CPU 20, and its storage contents are always held by the backup power supply 51.

Figure 6:
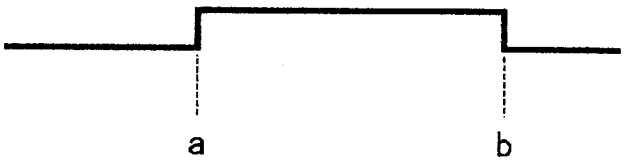
FIG. 6 is a chart showing the output signal of a paper discharge sensor.

In FIG. 5, the paper sheet 45 is conveyed in the direction of an arrow in FIG. 5 along the convey route 46 indicated by a dotted line. After a toner image is transferred from the photosensitive drum 43 onto the paper sheet 45 at a point c, the toner image is fixed by the fixing device 44, and the paper sheet 45 is then discharged. In this case, the paper discharge sensor 4 detects passage of the paper sheet. FIG. 6 shows the output signal from this paper discharge sensor 4. In FIG. 6, a timing a indicates that the leading end of the paper sheet has reached the paper discharge sensor 4 and its output has changed from L to H, and a timing b indicates that the trailing end of the paper sheet has passed the paper discharge sensor 4 and its output has returned from H to L. The CPU 20 detects that the paper sheet has been discharged based on this change in signal.

The operation of this embodiment will be described below with reference to the flow chart in FIG. 7.

When the image forming processing is started, a paper sheet is fed and conveyed to the point c in FIG. 5 in step 201. For this purpose, the CPU 20 controls various monitors, clutches, and the like (not shown) and starts electrophotography processes (202).

In step 203, the CPU 20 checks if the last image formation was NG. More specifically, it is checked if an undischarged paper flag, which goes OFF in step 204 when image formation was OK and the paper sheet was discharged, is ON. When the undischarged paper flag is ON, "1" is stored at a predetermined address in the RAM 41.

If it is determined in step 203 that the last image formation was OK (undischarged paper flag is OFF), the flow advances to step 204 to turn on the undischarged paper flag. The CPU 20 reads out the count value of the number of processed copied stored at a predetermined address in the EEPROM 1 in step 205, and increments the read count value (adds "1" thereto) in step 206. In step 207, the CPU 20 writes the incremented count value at the same predetermined address in the EEPROM 1, and the flow then advances to step 208.

If it is determined in step 203 that the last image formation was abnormal ("NG") no paper sheet was discharged (undischarged paper flag is ON), the flow advances to step 208. More specifically, only when it is determined in step 203 that the last image formation was OK, is the count value of the number of processed copies updated in steps 205 to 207. If "NG" is determined in step 203, the processing for turning on the undischarged paper flag is not performed in step 204, either. At that time, since the undischarged paper flag was turned on in the last image formation, the status of the undischarged paper flag need not be updated.

In step 208, the CPU 20 waits until the paper sheet is discharged. That is, the CPU 20 waits for a change in output signal from the paper discharge sensor 4 when the trailing end of the discharged paper sheet passes (the timing b in FIG. 6). If some trouble has occurred during this interval (209), the flow directly ends; if the paper sheet is normally discharged, the undischarged paper flag that was turned on previously was turned off in step 210.

The CPU 20 checks in step 209 whether or not a trouble has occurred by detecting if the arrival time of the leading end of the paper sheet at the paper discharge sensor 4 is earlier or later than the expected time, if the time required from the detection of the leading end to the trailing end of the paper sheet, i.e., the time between the timings a and b in FIG. 6, deviates from the expected value, or if the power supply is turned off, and so on. If trouble has occurred, the undischarged paper flag is kept stored at the predetermined address of the RAM 41 backed up by the battery, and is used in discrimination in step 203 in the next image formation.

In the flow chart shown in FIG. 7, if it is determined in step 203 that the last image formation was NG, the flow skips steps 204 to 207. Alternatively, in such case, the flow may skip only step 207 of writing the updated count value in the EEPROM 1.

Also, the count value of the number of processed copies need not be updated every time one paper sheet is processed. For example, when a plurality of copies are made continuously, the count value is simultaneously counted up in correspondence with the preset copy count, and if some trouble has occurred, an extra count value may be subtracted from the updated count value, and the difference may be rewritten in the EEPROM 1.

As described above, until the number of processed copies in the EEPROM in the exchange unit is updated, electric power is kept supplied. Hence, even when a power OFF operation is made immediately after a paper sheet subjected to image formation processing is discharged, data destruction of the EEPROM in the exchange unit can be prevented.

Since the number of processed copies stored in the EEPROM in the exchange unit is updated before the end of the image formation processing, even when a power OFF operation is made immediately after a paper sheet is discharged, data destruction of the EEPROM can be prevented. Only when the image formation cannot be performed normally due to a paper jam, power failure, or the like, the number of processed copies stored in the EEPROM is not updated in the next image formation processing, thus preventing data destruction of the EEPROM.

The present invention is not limited to the above-mentioned embodiments, and various modifications may be made within the scope of the claims.

What is claimed is:

1. An image forming apparatus in which an exchange unit having a memory is mountable, comprising:

a power supply for said image forming apparatus;

a power supply control circuit for turning on/off said power supply in response to an operation of a power switch;

discharge means for discharging a recording sheet on which an image is formed;

a sensor for detecting the recording sheet discharged by said discharge means;

updating means for, when said sensor detects the discharging of the recording sheet, updating data stored in the memory of the exchange unit; and maintaining means for maintaining a supply state of said power supply to said updating means even when the power switch is turned on/off during the updating processing of said updating means, and stopping the supply of power to said updating means after the updating processing.

2. An apparatus according to claim 1, wherein said updating means performs the updating processing every time said sensor detects the discharging of the recording sheet.

3. An apparatus according to claim 1, wherein said updating means performs the updating processing when said sensor detects the discharging of the recording sheet in units of a predetermined number of image forming operations.

4. An apparatus according to claim 1, wherein the memory stores data indicating an accumulated number of image forming operations in the exchange unit.

5. An apparatus according to claim 1, further comprising:

checking means for checking, based on the data stored in the exchange unit, if the exchanged unit's life is finished.

6. An image forming apparatus in which an exchange unit having a memory is mountable, comprising:

a power supply for said image forming apparatus;

updating means for updating data stored in the memory after a recording sheet on which an image is formed is discharged; and maintaining means for postponing the power OFF timing until the updating processing completes and maintaining power supply when a power OFF instruction is issued during the updating processing of said updating means.

7. An apparatus according to claim 6, wherein the memory stores data indicating an accumulated number of image forming operations in the exchange unit.

8. An apparatus according to claim 6, further comprising:

checking means for checking, based on the data stored in the exchange unit, if the exchange unit's life is finished.

9. An image forming apparatus in which an exchange unit having a memory is mountable, comprising:

updating means for updating data stored in the memory in synchronism with feeding of a recording sheet;

determination means for determining whether or not image formation onto the recording sheet has been normally completed; and inhibition means for inhibiting updating processing of said updating means in a next image formation when said determination means determines that the image formation has not been normally completed.

10. An apparatus according to claim 9, further comprising:

a non-volatile memory for, when said determination means determines that the image formation has not been normally completed, storing error data indicating that the image formation has not been normally completed, and wherein said inhibition means inhibits the updating processing when said non-volatile memory stores the error data.

11. An apparatus according to claim 9, further comprising:

second determination means for determining a life of the exchange unit on the basis of data stored in the memory of the exchange unit.

12. An apparatus according to claim 9, wherein the memory stores data indicating an accumulated number of image forming operations in the exchange unit.

13. An image forming apparatus in which an exchange unit having a memory is mountable, comprising:

discharge means for discharging a recording sheet on which an image is formed;

a sensor for detecting the recording sheet discharged by said discharge means;

updating means for, when said sensor detects the discharging of the recording sheet, updating data stored in the memory of the exchange unit;

a power supply for an image forming unit within said image forming apparatus and for said updating means;

a power supply control circuit for turning on/off said power supply in response to an operation of a power switch; and maintaining means for maintaining a supply state of said power supply to said updating means even when the power switch is turned on/off during the updating processing of said updating means, and stopping the supply of power from said power supply to said updating means after the updating processing.

14. An apparatus according to claim 13, wherein the memory stores data indicating an accumulated number of image forming operations in the exchange unit.

15. An apparatus according to claim 14, further comprising:

checking means for checking, based on the data stored in the exchange unit, if the exchange unit's life is finished.

16. An image forming apparatus in which an exchange unit having a memory is mountable, comprising:

updating means for updating data stored in the memory after a recording sheet on which an image is formed is discharged;

a power supply for an image forming unit within said image forming apparatus and for said updating means; and maintaining means which, in response to an instruction to turn off said power supply during the updating processing of said updating means, postpones a cutting off of power to said updating means until the updating processing has been completed.

17. An apparatus according to claim 16, wherein the memory stores data indicating an accumulated number of image forming operations in the exchange unit.

18. An apparatus according to claim 16, further comprising:

checking means for checking, based on the data stored in the exchange unit, if the exchange unit's life is finished.

19. An image forming apparatus comprising:

discharge means for discharging a recording sheet on which an image if formed;

a sensor for detecting the recording sheet discharged by said discharge means;

updating means for, when said sensor detects the discharging of the recording sheet, updating data stored in a memory;

a power supply for an image forming unit within said image forming apparatus and for said updating means;

a power supply control circuit for turning on/off said power supply in response to an operation of a power switch; and maintaining means for maintaining a supply state of said power supply to said updating means even when the power switch is turned on/off during the updating processing of said updating means, and stopping the supply of power to said updating means after the updating processing.

20. An apparatus according to claim 19, wherein the memory stores data indicating an accumulated number of image forming operations in an exchange unit mountable in said image forming apparatus.

21. An apparatus according to claim 19, further comprising:

checking means for checking, based on the data stored in the memory, if an exchange unit mountable in said image forming apparatus has reached the end of its life.

22. An image forming apparatus comprising:

updating means for updating data stored in a memory after a recording sheet on which an image is formed is discharged;

a power supply for an image forming unit within said image forming apparatus and for said updating means; and maintaining means which, in response to an instruction to turn off said power supply during the updating processing of said updating means, postpones a cutting off of power to said updating means until the updating processing has been completed.

23. An apparatus according to claim 22, wherein the memory stores data indicating an accumulated number of image forming operations in an exchange unit mountable in said image forming apparatus.

24. An apparatus according to claim 22, further comprising:

checking means for checking, based on the data stored in the memory, if an exchange unit mountable in said image forming apparatus has reached the end of its life.

* * * * *

UNITED STATES PATENT AND TRADEMARK OFFICE

CERTIFICATE OF CORRECTION

PATENT NO. : 5,878,298

DATED : March 2, 1999

INVENTOR(S) : MASAKI NAKANO

It is certified that error appears in the above-identified patent and that said Letters Patent is hereby corrected as shown below:

COLUMN 1

Line 37, "turned off" should read --discharged, if--;
Line 38, "during the interval from the timing immediately" should read --the power switch is turned off or the like--;
Line 60, "he" should read --the--;
Line 62, "e" should read --the--; and
Line 65, "s" should read --is--.

COLUMN 2

Line 2, "the" should read --in the--.

COLUMN 4

Line 49, "copied" should read --copies--.

COLUMN 6

Line 18, "exchanged" should read --exchange--.

UNITED STATES PATENT AND TRADEMARK OFFICE

CERTIFICATE OF CORRECTION

PATENT NO. : 5,878,298

DATED : March 2, 1999

INVENTOR(S) : MASAKI NAKANO

It is certified that error appears in the above-identified patent and that said Letters Patent is hereby corrected as shown below:

COLUMN 7

Line 50, "if" should read --is--.

Signed and Sealed this

Eleventh Day of January, 2000

*Attest:*

*Attesting Officer*

Q. TODD DICKINSON

*Acting Commissioner of Patents and Trademarks*